United States Patent [19]

Park

[11] 4,375,329

[45] Mar. 1, 1983

[54] TALKING COPIERS AND DUPLICATORS

[75] Inventor: Kenneth K. Park, Fairport, N.Y.

[73] Assignee: Xerox Corporation, Stamford, Conn.

[21] Appl. No.: 157,716

[22] Filed: Jun. 9, 1980

[51] Int. Cl.[3] ..... G03G 15/00

[52] U.S. Cl. ..... 355/14 C; 179/1 SM

[58] Field of Search ..... 355/14 R, 14 C; 179/1 SM

[56] References Cited

U.S. PATENT DOCUMENTS

| | | | |
|---|---|---|---|
| 3,648,256 | 3/1972 | Paine et al. . | |
| 3,689,151 | 9/1972 | Hofmann et al. | 355/14 R |
| 4,144,550 | 3/1979 | Donohue et al. | 355/14 C |
| 4,176,941 | 12/1979 | Breitenkam et al. | 355/14 R |

FOREIGN PATENT DOCUMENTS

| | | | |
|---|---|---|---|
| 2948132 | 6/1980 | Fed. Rep. of Germany | 355/14 C |
| 2014765 | 8/1979 | United Kingdom | 179/1 SM |

OTHER PUBLICATIONS

*Electronic Design,* 24, Nov. 22, 1978; pp. 160–162; "Tired of Just Reading Results? Let Your Instruments Do The Talking" by Vijay B. Tandon; 179, ISM. Research Disclosure 19215, Apr. 1980; "Verbal Communication with Copier/Duplicator", by J. Addison Mathews.

*Primary Examiner*—C. D. Miller
*Assistant Examiner*—Keith E. George
*Attorney, Agent, or Firm*—Ronald F. Chapuran

[57] ABSTRACT

The present invention is a speech module including a central processing unit, a memory, a continuously variable slope delta demodulator, and related filter, amplifier, and speaker circuits connected to a master controller in a reproduction machine. Upon sensing certain machine conditions, the master controller provides suitable signals to the voice response module. In response, the voice response module locates starting addresses and lengths of words and phrases and reproduces the appropriate response. In one embodiment, the speech module is connected to a shared line communication system.

1 Claim, 11 Drawing Figures

TALKING COPIERS AND DUPLICATORS

This invention relates to voice response and in particular to a speech synthesis module for the control and diagnostics of a reproduction machine and also adapted for interconnection with a shared communication line.

Over the next decade, there is likely to be a proliferation of copier features, making reproduction machines more complex to operate by casual operators. Therefore, product operability and human factor features including minimal operator training become an important design consideration. To simplify operation, various control systems have been used in the prior art such as indicator lamps, displays, backlit messages, and various display codes directing the operator to instruction cards. These techniques have been used to provide operator assistance, simplify jam clearance and job recovery, stop improper procedures, and provide tech rep assistance.

Another technique of operator assistance is the use of speech communication. The technology of speech communication generally covers two broad categories, waveform coding and voice coder (vocoder) techniques such as parameter representation, synthesis by rule, and text to speech.

The vocoder techniques generally involve the use of phonemes. These phonemes are the smallest units of speech sound in a particular language serving to distinguish one utterance or sound from another. There are approximately 40 of these phonetic sounds in the English language. These phonemes are stored in memory in digital format and then selected from memory in the proper sequence and synthesized according to certain rules to produce the desired speech or message. Although phoneme techniques generally require less storage, and the bit rate is relatively low, the speech is of lesser quality than using waveform coding techniques. Another disadvantage of the phonem technique is the need to structure the language into basic sounds. It is therefore difficult to adapt the system for different languages.

As examples of the vocoder technique, U.S. Pat. No. 4,163,120 shows the use of a microprocessor, input/output device, memory, digital to analog converters and a speaker to produce speech waveforms by means of either time compression or time expansion of stored basis functions representing certain speech waveforms within a pitch period. U.S. Pat. No. 3,870,818 discloses the use of a word storage unit and speech synthesizer together with transducers detecting machine conditions. This system, however, may require relatively large storage for messages.

The advantage of waveform coding techniques in addition to being of generally high quality is the multilanguage versatility and the ready adaptability to relatively small message and vocabulary requirements. In waveform coding techniques such as pulse code modulation and continuously variable slope delta modulation, the speech waveform is digitized. In pulse code modulation the quantizied waveform is sampled at specific points and the coded pulse is transmitted in binary form. In delta modulation, signal differences are encoded using only one bit for each sample and the coding indicates where the waveform amplitude increases or decreases at the sampling instant. In general, the pulse code modulation techniques have the highest bit rate and require the most memory. On the other hand, the continuously variable slope delta modulation technique has a relatively low bit rate and requires less memory.

Many applications require only a limited vocabulary. Other applications are intended to be adapted to many languages and also require a minimum degree of voice quality. It would therefore be desirable to provide a speech communications system having an acceptable level of speech quality and applicable to many languages.

Examples of delta modulation techniques are U.S. Pat. No. 3,750,024 showing a predictive type system. Also, U.S. Pat. No. 4,121,051 shows the use of 40 memory devices to produce speech. A keyboard switch selects a desired data stream output from an addressed memory and guides the data to a controlled variable slope delta modulator producing analog representations of the desired sound. These systems although using delta modulation techniques are relatively complex and relatively uneconomical to implement. They are hardwire fixed and not generally flexible. In addition, they are not easily adapted to central communication systems. It would also be desirable, therefore, to provide an economical and relatively simple speech communication system adaptable to a central communication system.

It is a main object of the present invention to provide a new and improved speech communication system in a reproduction machine, and in particular an economical, multilanguage speech communication system adapted for interconnection with a central processing system.

Further objects and advantages of the present invention will become apparent as the description proceeds and the features of novelty characterizing the invention will be pointed with particularity in the claims annexed to and forming a part of this specification.

Briefly, the present invention is concerned with a speech module including a central processing unit, a memory, a continuously variable slope delta demodulator, and related filter, amplifier, and speaker circuits connected to a master controller in a reproduction machine. Upon sensing certain machine conditions, the master controller provides suitable signals to the voice response module. In response, the voice response module locates starting addresses and lengths of words and phrases and reproduces the appropriate response. In one embodiment, the speech module is connected to a shared line communication system.

For a better understanding of the present invention, reference may be had to the accompanying drawings wherein the same reference numerals have been applied to like parts and wherein.

Figure 1:
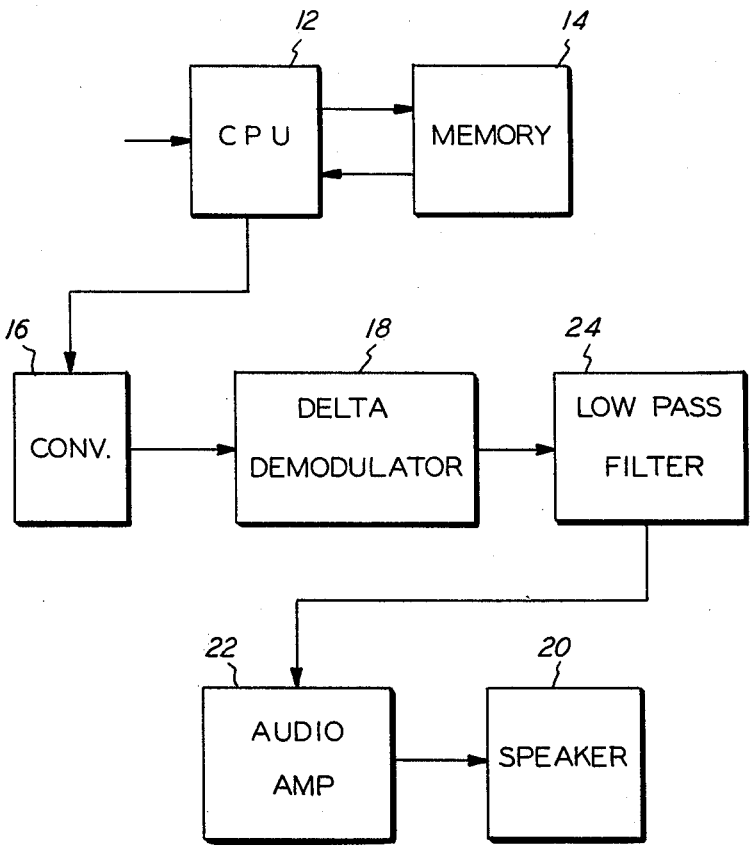
FIG. 1 is a block diagram of the decoding process in the speech communication system according to the present invention.
Figure 4:
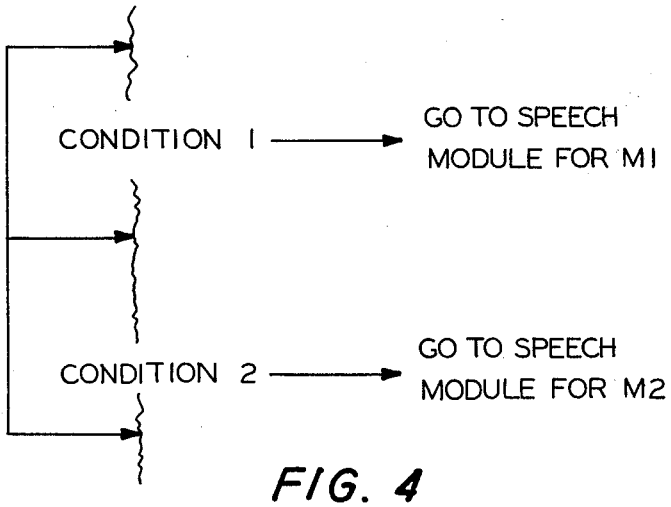
Figure 3A:
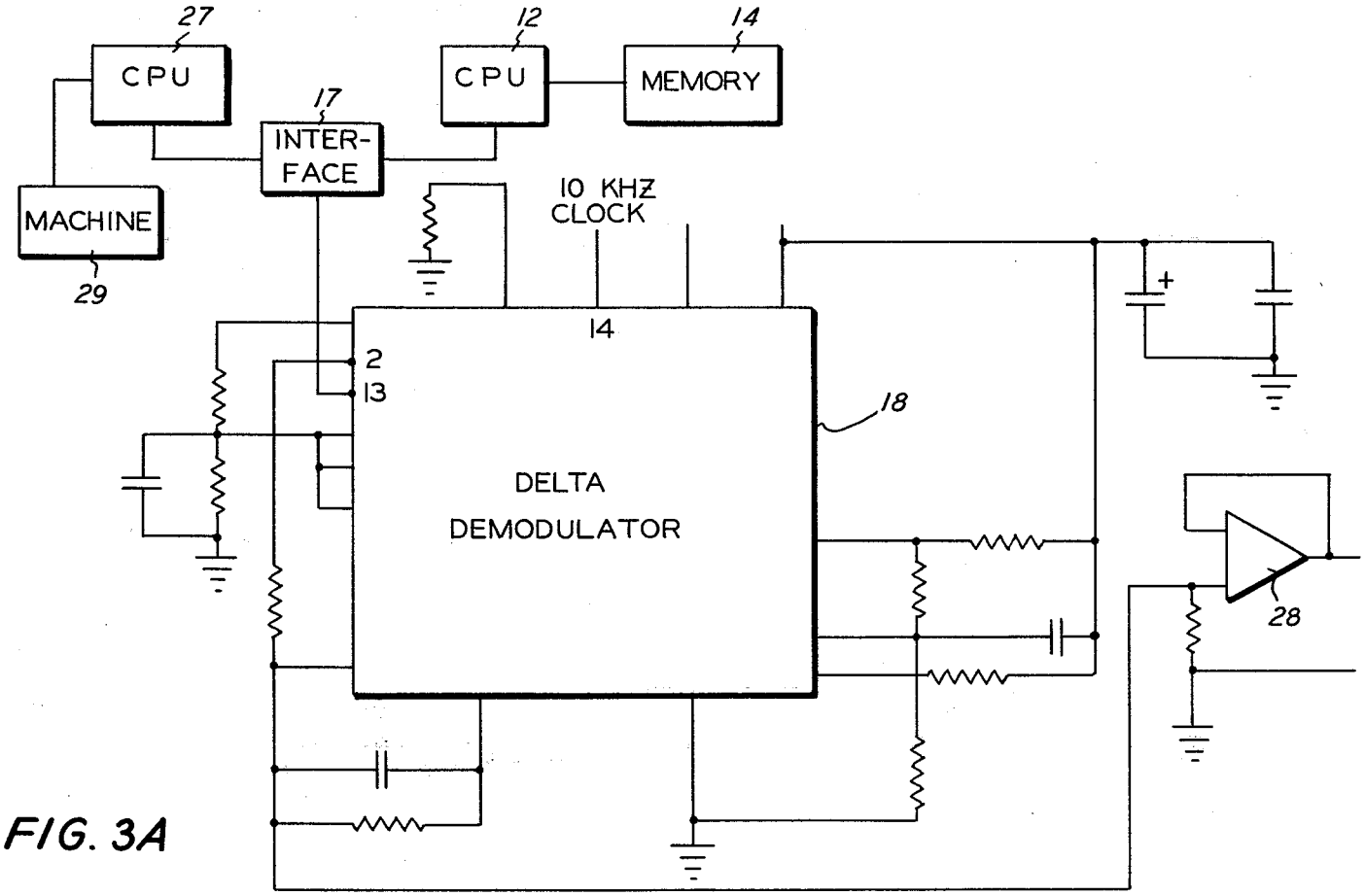
Figure 3B:
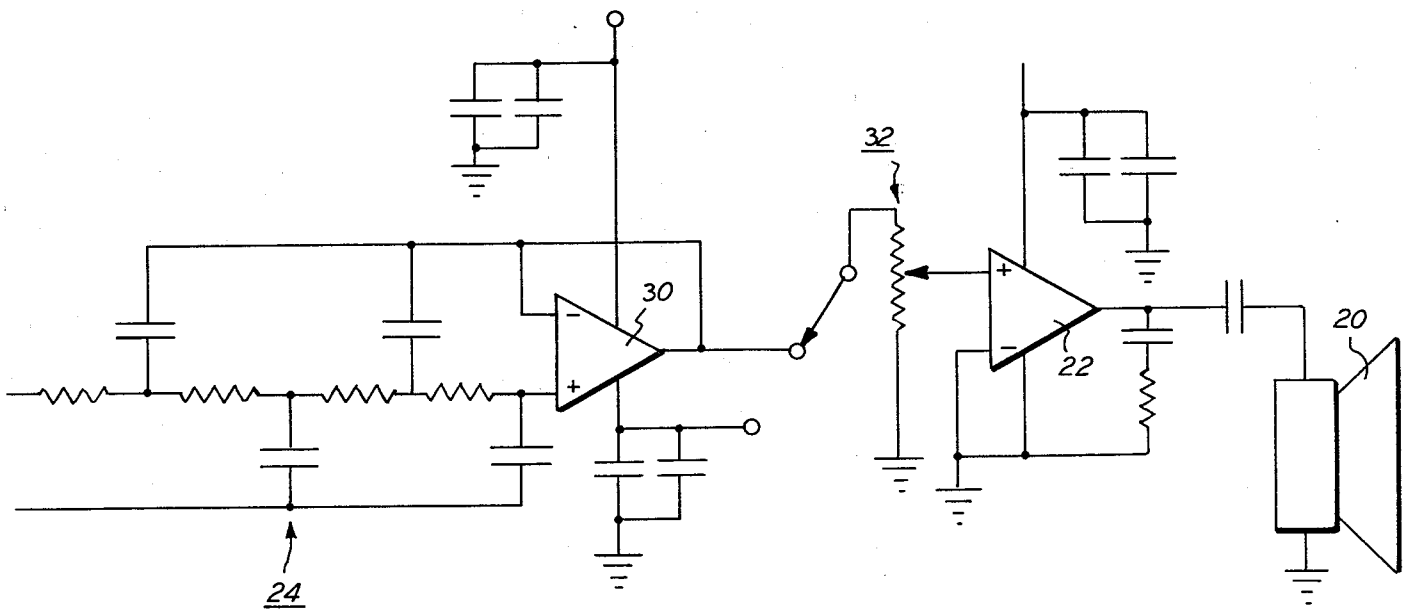
Figure 5:
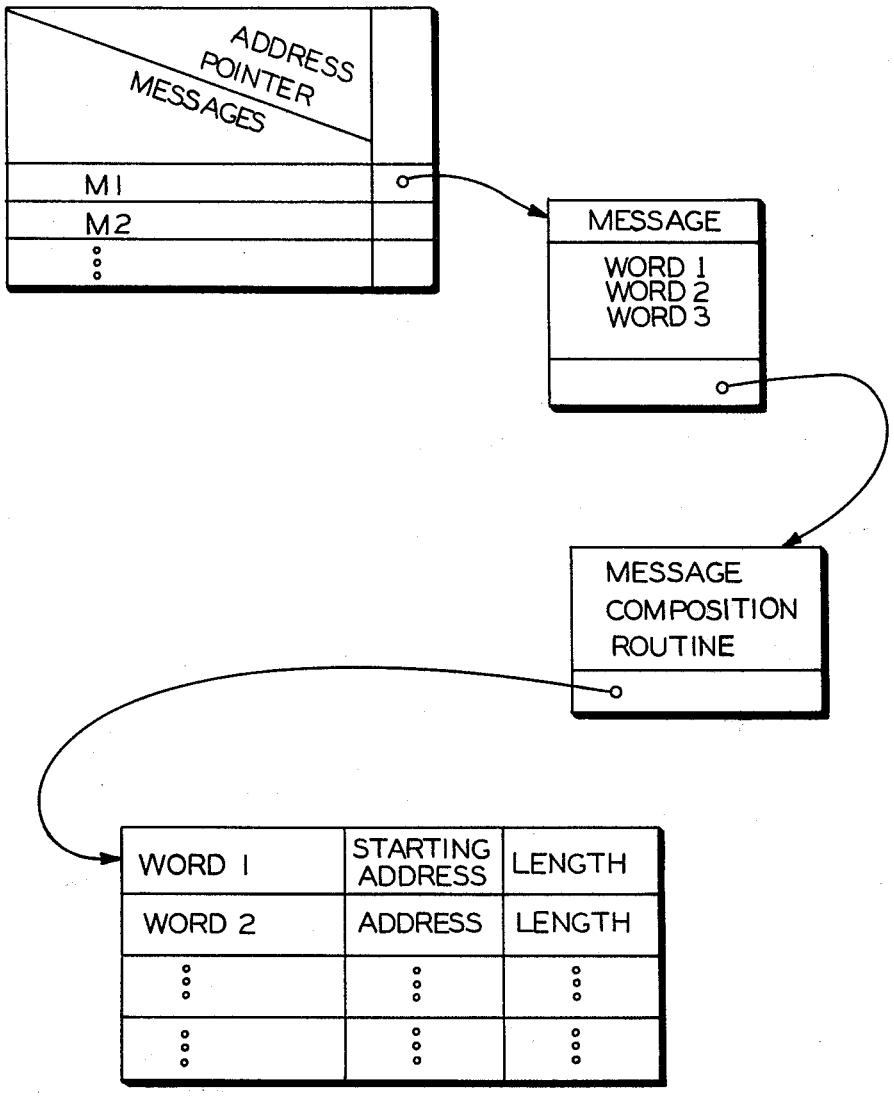
Figure 6:
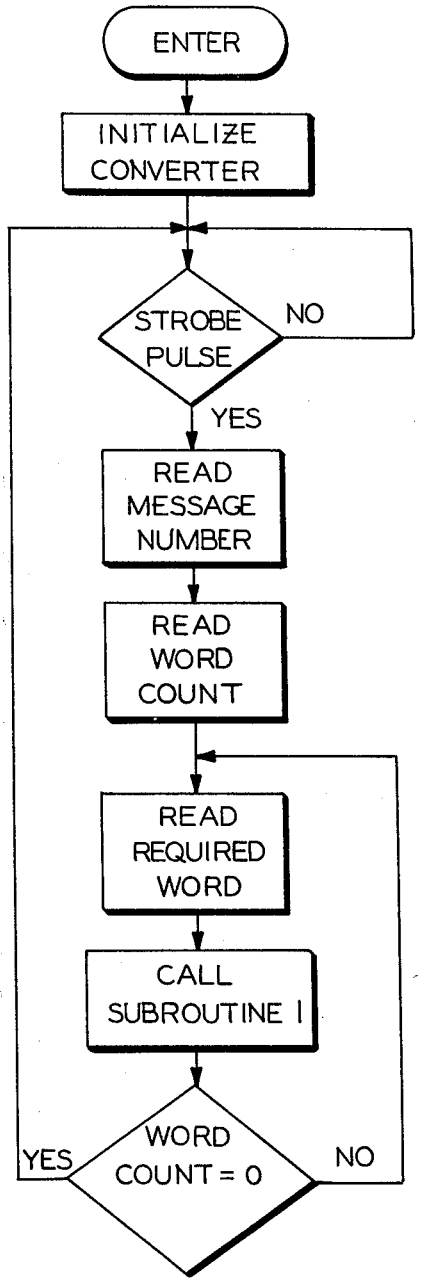
Figure 7:
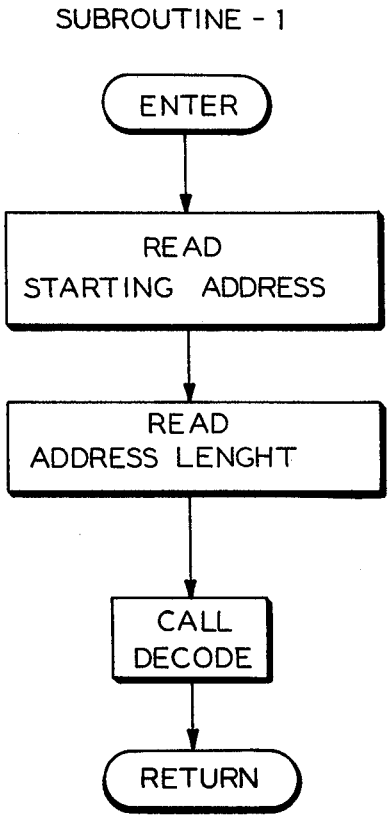
Figure 8:
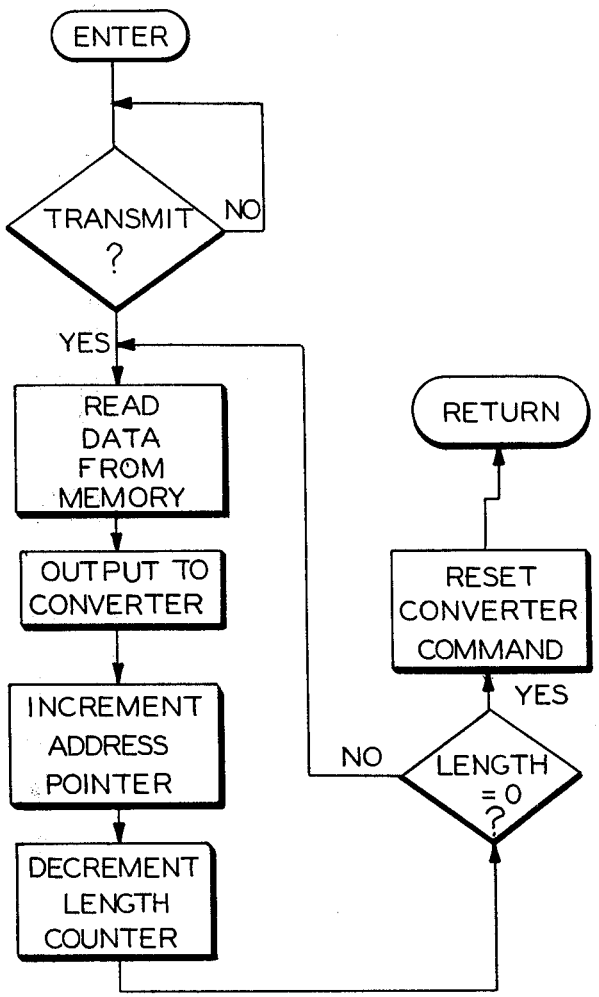
Figure 9:
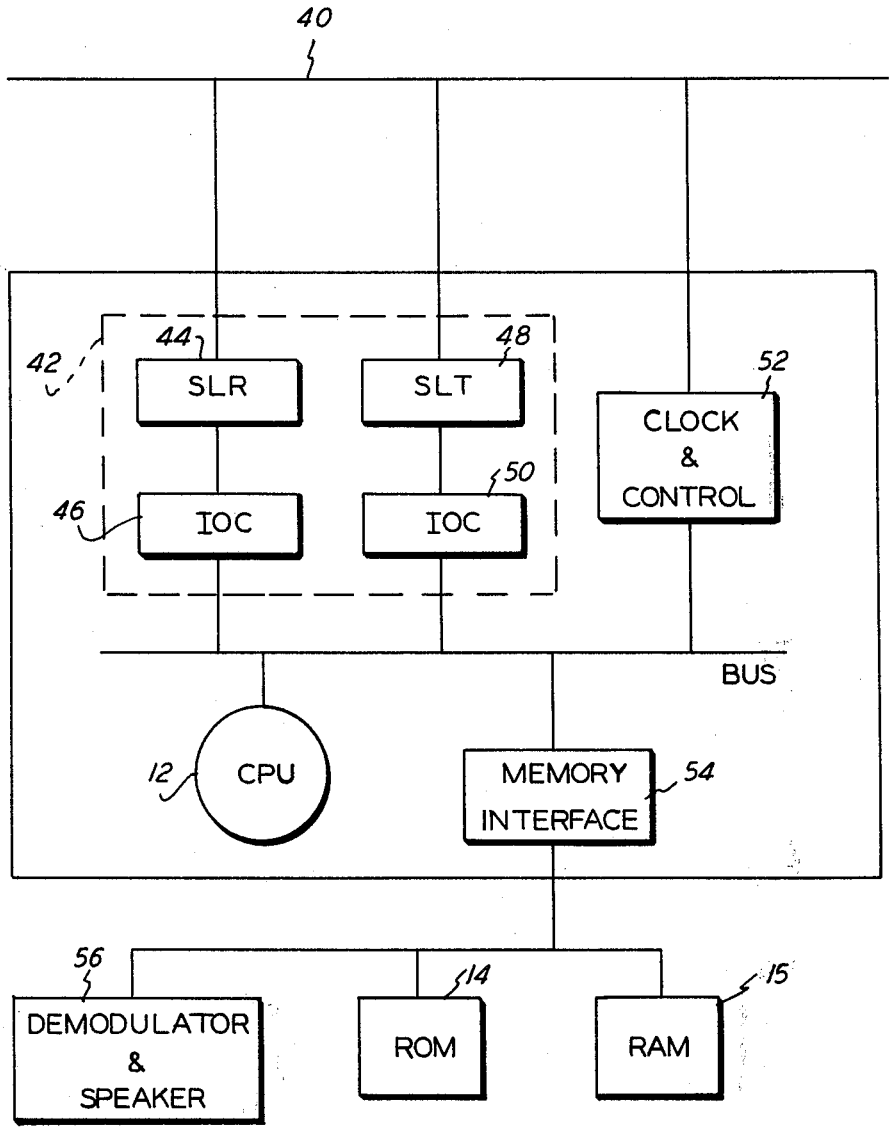
Figure 10:
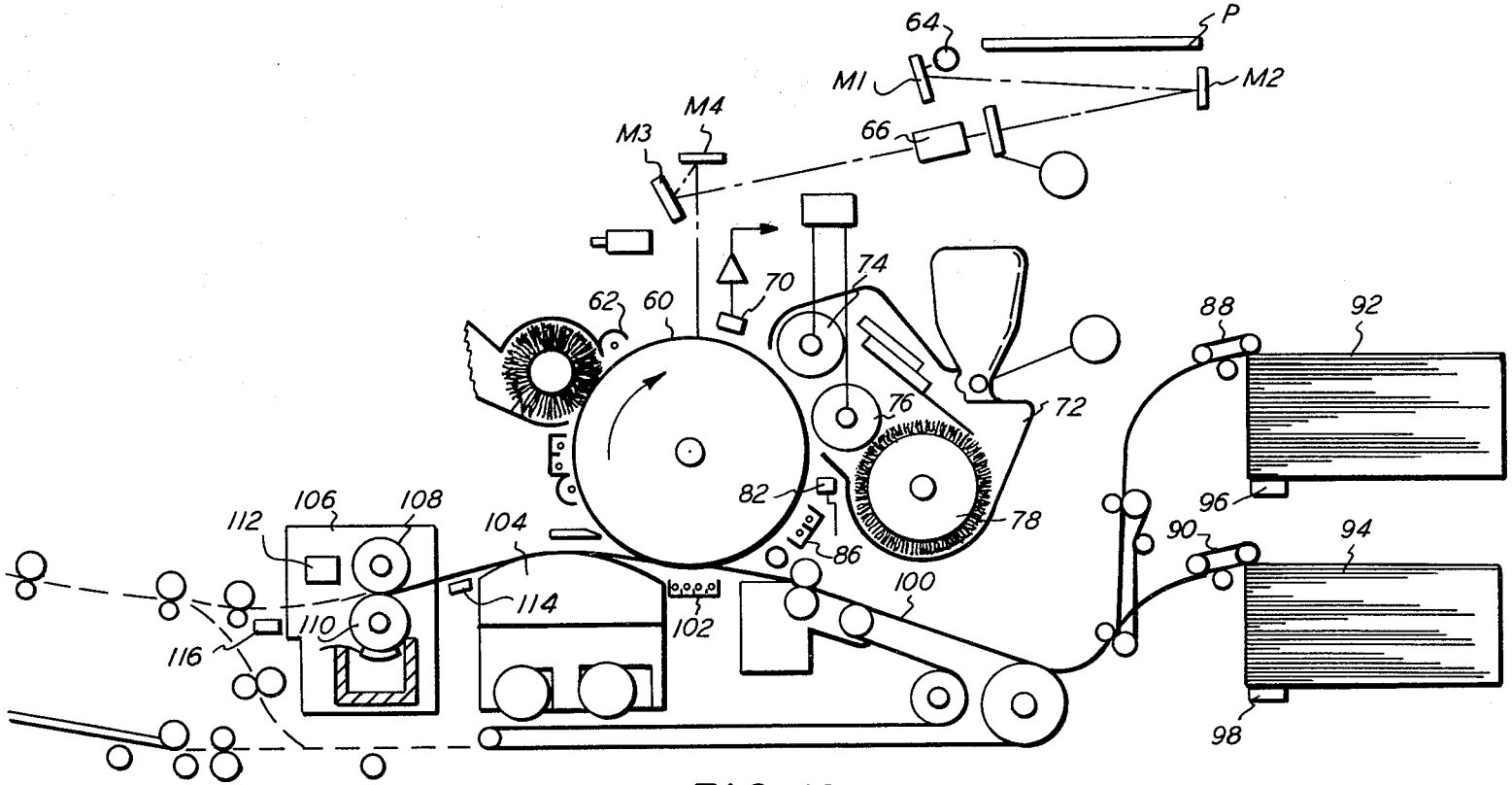

FIGS. 3*a* and 3*b* are detailed schematics of the decoding process in FIG. 1;

FIGS. 4 and 5 are illustrations of the message read out procedure;

FIGS. 6, 7 and 8 are flow charts illustrating the procedure for addressing the speech communication module and reading out the required message;

FIG. 9 is a block diagram illustrating the interconnection of the speech module to a shared line or master control system; and FIG. 10 is a pictorial view of a reproduction machine incorporating the present invention.

With reference to FIG. 1, there is shown a speech communication module including a central processing unit CPU 12, a solid state memory 14 storing messages in digital form, a parallel to serial converter 16, and a delta demodulator 18. The module is suitably connected to a speaker 20 through an audio amplifier 22 and low pass filter 24. It should be noted that selected messages are first stored in memory 14. In the storage or encoding process, voice signals or words are bandpass filtered and converted into digital words at a suitable clock rate by a suitable modulator such as a continuously variable slope delta modulator. The digital words or serial data bit stream is then converted into 8 bit parallel bytes and stored in memory 14 one byte at a time.

For decoding, one byte at a time is converted into serial data bits. The serial data bit is reconstructed into an audio signal in the demodulator 18 and is then converted through the low pass filter 24 and amplifier 22 to the speaker 20. In a preferred embodiment, there are approximately 200 words stored in memory.

Preferably, the decoder or demodulator 18 is a continuously variable slope delta modulator/demodulator such as Motorola MC3417, and the memory is any suitable solid state ROM memory. Preferably, the CPU is an Intel 8085 and the system is operated at a 10 kilohertz bit rate, providing acceptable voice quality. However, it should be understood that greater memory capacity and a higher bit rate such as a 16 kilohertz bit rate provides much higher quality. The converter 16 is any suitable parallel to serial converter preferably a Universal Synchronous and Asynchronous Receiver and Transmitter (USART).

Figure 2:
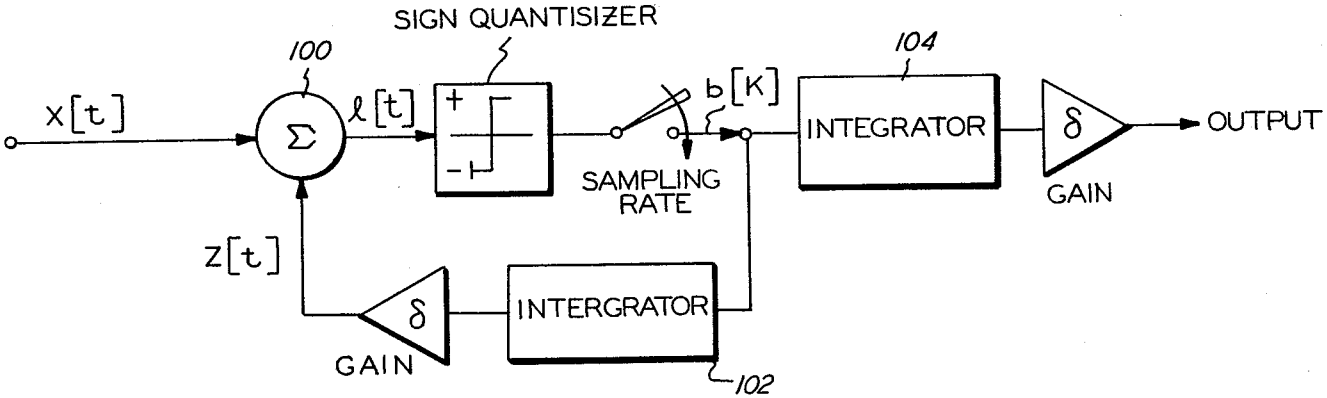
FIG. 2 is a sketch of the delta de-modulation technique.

Digital delta modulation/demodulation, with reference to FIG. 2, is a technique by which an analog input signal, x(t), is encoded into a sequence of binary digits, [b(k)], by periodically comparing the input signal to an estimate signal, z(t). If the error, e(t), between the signal and the estimate is positive, then the bit is $+1$; if the error is negative, then the bit is $-1$.

The estimate, formed from the entire sequence of previously generated delta modulation (DM) bits, is made to approximate, very closely, the input signal by appropriately increasing or decreasing according to a prescribed algorithm. The amount of change that the estimate undergoes is called the delta modulation step size, S(k).

The mathematical description of digital delta modulation is given by the following set of equations:

$$b(k)=Sgn[e(k)], \quad (1)$$

$$e(k)=x(k)-Z(k), \quad (2)$$

and $$z(k)=z(k-1)+S(k) \quad (3)$$

where k denotes the $k^{th}$ time interval.

For a linear delta modulation the step-size algorithm is given by the following equation:

$$S(k)=\alpha b(k-1) \quad (4)$$

where $\alpha$ denotes the magnitude of the minimum step size.

For this case the maximum slope that the encoder can track is given by $$[\text{slope}]_{max}=(\alpha/T_s)=\alpha f_s \quad (5)$$

where $T_s$ and $f_s$ denote sampling time and frequency respectively.

The delta modulator shown in FIG. 2 consists of a comparator 100 in the forward path and an integrator 102 in the feedback path of a simple control loop. The inputs to the comparator 100 are the input analog signal x(t) and the integrator 102 output. The comparator output reflects the sign of the difference between the input signal and the integrator output. That sign bit is the digital output and also controls the direction of ramp in the integrator 104. The comparator output is normally clocked so as to produce a synchronous digital bit stream. Low pass filtering at the receiver output will eliminate most of the quantizing noise if the clock rate of the bit stream is an octave or more above the bandwidth of the input signal.

With reference to FIGS. 3*a* and 3*b*, in accordance with the present invention, pin 13 of the delta demodulator 18 is interconnected to interface 17, preferably including converter 16, in turn interconnected to the CPU 12. The interface 17 is also suitably connected to a master CPU 27, in turn connected to a controlled device such as reproduction machine 29. The clock signal to the demodulator 18 is input at pin 14 and the output from the demodulator from pin 2 is passed through low pass filter shown generally at 24. The output from the filter 24, in particular, from op amplifier 30 is conveyed through a volume control 32 to the input of the audio amplifier 22, then to speaker 20.

On sensing certain machine conditions, the master CPU 27 will send a signal to the voice response control, CPU 12, to provide a message corresponding to the sensed condition. The CPU 12, in turn, acknowledges receipt of the signal and then in succession locates the starting addresses and lengths of the appropriate words. The words are then linked to form the requested message.

With reference to FIG. 4, a condition 1 sensed by the master CPU 27 will cause the CPU 12 to provide message M1. Similarly, condition 2 will cause the CPU 12 to provide message 2. In particular as shown in FIG. 5, a directory is provided in the speech controller CPU 12. Upon receipt of machine condition one, corresponding to message one, an address pointer will designate the words to make up message one and the words will be composed into the appropriate message. The words will then be accessed from memory 14 beginning with the address of word one, until the message is completed. The digitized words are read from memory 14 in the proper sequence through the parallel to serial converter 16 to the demodulator 18.

FIGS. 6, 7 and 8 are flow charts showing the decoding procedure. In the decoding process, upon a certain command or sensed condition as evidenced by a strobe pulse, data is fetched from computer memory and is converted into serial bit streams of zeroes and ones through the USART or converter 16 and reconstructed into its original waveform via the demodulator 18. The waveform is smoothed by low pass filter 24 and amplified and sent to the speaker 20. The first step in the process with reference to FIG. 6 is to initialize the converter 16. The next step shown by the decision block is to look for a strobe pulse. If there is a strobe pulse, the next step is to read the message number. That is, each observed event or machine condition is assigned a number corresponding to a particular message in memory and when the event or condition occurs, the corresponding number is indicated. After reading the message number, the number of words in the particular message is determined and a word number counter set. For example, in a preferred embodiment, the message "add toner please" is assigned number 12 and contains three words.

The next step is to read the required word of the message (either the first, second or third word of the example) and call the word subroutine, identified as subroutine one. The final step in FIG. 6 is a decision block to determine if the word count is zero. If yes, the system loops back to the next strobe pulse for the next message number. If no, the system loops to read the next word of the message. The second flow chart, FIG. 7, shows the details of subroutine one. In particular, after the subroutine is entered for each word of the message, the starting addresses and length of each word is read. The next step is to call the decode routine as shown in FIG. 8.

With reference to FIG. 8, for the decode routine there is an initial determination whether or not to transmit. If a message is required, the first message word is read from the memory location identified in subroutine 1. The data contained in the first memory location identified in subroutine 1 is conveyed to the converter or USART 16 (and to the speaker 20). The address pointer is then incremented to locate the next byte of data in memory for the first message word. For example, the word "paper" requires approximately 300 bytes of data. However, it should be understood that with further data compression techniques, the data storage requirement could be substantially reduced.

The number of bytes in a word is stored in a counter. The next step, therefore is to decrement the word length counter. When the counter is decremented to zero, a command is given to reset the converter 16 to prepare to transmit another word. At this time, the message transmit signal is also shut off. The decode routine then returns to the subroutine 1 and in turn returns to the call subroutine 1 block of the flow chart of FIG. 4.

A determination of word count is then made. As already described, if another word is required, the routine loops to the read next message word block and the call subroutine and call decode routines are repeated. On the other hand, if all the words of a given message have been read from memory, the routine of FIG. 4 loops back to the strobe pulse decision block. That is, decoding is terminated until another message command is given.

According to the present invention, the speech module is also adapted for interconnection to a communication line. With reference to FIG. 9, there are shown a common communication line 40, communication interface circuitry 42 including shared logic receive circuitry SLR 44 and related interface circuitry IOC 46, shared logic transmit circuitry SLT 48 and related interface circuitry IOC 50, clock and control logic 52, the speech module control microprocessor CPU 12, a memory interface 54, ROM memory 14, RAM memory 15 and the demodulator and speaker as represented in block 56.

The appropriate message request is received through SLR 44 and IOC 46 by CPU 12 over the communication line 40 from master CPU 27. In response, CPU 12 addresses ROM 14 for the requested message and the digital passage is demodulated and converted into the appropriate voice message. The shared logic transmit circuitry 48 and interface circuitry 50 are available to send suitable acknowledge signals to CPU 27 over the communication line 40.

With reference to FIG. 10, there is shown a reproduction machine incorporating the present invention. In particular, a drum having a photoconductive surface 60 is rotated, in the direction of the arrow through a charging station. The charging station employs a corona generating device 62 having a charging electrode and conductive shield positioned adjacent photoconductive surface 60 to charge the photoconductive surface to a relatively high uniform potential. The charged portion of photoconductive surface is then rotated to an exposure station for producing a light image of an original document placed on platen P. In particular, lamp 64 illuminates incremental portions of the original document disposed on platen P in moving across the platen P. The light rays reflected from the original document are reflected by a pair of mirrors M1, M2 through lens 66 to another pair of mirrors M3, M4 and onto surface 60. The surface 60 rotates in synchronism with the movement of the platen scanning optics. Preferably, an electrometer 70 is provided near the photoreceptor for sensing voltage levels on the surface 60.

As the surface continues to rotate in the direction of the arrow, the recorded electrostatic latent image is advanced to a development station including a housing 72 containing a supply of developer material and a pair of developer rollers 74 and 76. The developer material is advanced to developer rollers 74 and 76 by paddle wheel 78 disposed in the sump of housing 72. Developer rollers 74 and 76 advance the developer material into contact with the electrostatic latent image on surface 60. Preferably, an infrared densitometer (IRD) 82 senses the degree of development on a test portion of the photoreceptor.

After the toner powder image has been developed on photoconductive surface 60, corona generating device 86 applies a charge to precondition the toner powder image for transfer. A sheet of support material is advanced by sheet feeding apparatus 88 or 90 from either tray 92 or tray 94. Suitable detectors such as copy sheet sensors 96 and 98 are preferably provided to indicate a tray empty condition. Conveyor system 100 advances the sheet of support material to a transfer station including a corona generating device 102 for charging the underside of the sheet of support material to a level sufficient to attract the toner powder image from photoconductive surface 60.

After transfer of the toner powder image to the sheet of support material, a vacuum stripping system 104 separates the sheet from photoconductive surface 60 and advances it to a fusing station 106. The fusing station 106 includes a heated fuser roll 108 in contact with a resilient backup roll 110. The sheet of support material advances between fuser roll 108 and backup roller 110 with the toner powder image contacting fuser roll 108. After the toner powder image has been permanently fused to the copy sheet, the copy sheets are advanced by a series of rollers to suitable (not shown) output trays. A suitable thermostat 112 is provided to monitor fuser temperature. Suitable copy sheet detectors 114 and 116 are also provided to monitor the paper path for paper jams.

The signals provided by the various sensors and detectors, such as electrometer 70, IRD 82, copy sheet sensors 96 and 98, copy sheet detectors 114 and 116 and thermostat 112 are conveyed to a suitable controller such as master CPU 27 in FIG. 3*a*, communicating with CPU 12 and memory 14.

In a typical application, associated with the various sensors and detectors are appropriate messages stored in memory 14 such as "add toner", "add paper", "clear paper jam" and "check fuser". Upon the detection by the controller or master CPU 27 of the appropriate sensor condition, such as paper tray empty, the machine control will designate the appropriate message in suitable word sequences stored in the memory 14. The control will address the appropriate memory location and the words or strings of data will be conveyed to the demodulator 18 and the appropriate vocal response will be given.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. In a reproduction machine for producing impressions of an original, the reproduction machine having a photosensitive member and a plurality of discrete operating components including a fuser, a developer, and a copy paper feeder cooperable with one another and the photosensitive member to electrostatically produce the impressions on the copy paper, the reproduction machine including a paper path sensor, a fuser control sensor and a development control sensor, the improvement comprising, a machine controller including a master controller, a shared communication channel, shared logic receive and transmit circuitry, a speaker and associated amplifier, a speech communication module including a microprocessor, a memory, a continuous variable slope delta demodulator, and a converter and filter interconnecting the communication module to the speaker amplifier, the shared logic receive and transmit circuitry interconnecting the master control and the microprocessor, the speech communication module responding to sensed machine conditions to provide an audio response through the speaker.

* * * * *